United States Patent [19]

Gillette

[11] 4,264,792

[45] Apr. 28, 1981

[54] SAFETY LOCKING SYSTEM

[75] Inventor: Robert Gillette, Angola, Ind.

[73] Assignee: Brammall, Inc., Angola, Ind.

[21] Appl. No.: 77,351

[22] Filed: Sep. 20, 1979

[51] Int. Cl.[3] ..... H01H 27/00

[52] U.S. Cl. ..... 200/44; 200/276

[58] Field of Search ..... 200/44, 276

[56] References Cited

U.S. PATENT DOCUMENTS

| | | | |
|---|---|---|---|
| 3,026,385 | 3/1962 | Davis et al. | 200/44 |
| 3,665,128 | 5/1972 | Schaad et al. | 200/44 |
| 4,075,877 | 2/1978 | Van Gompel | 70/34 |

*Primary Examiner*—Willis Little

*Attorney, Agent, or Firm*—Hill, Van Santen, Steadman, Chiara & Simpson

[57] ABSTRACT

A safety locking switch that can connect a selected wire to a grounded plate, on which the switch is mounted, has a metallic housing, a key operated lock mounted in the housing, an insulator affixed to the housing and an electrical lead extending through the insulator into the housing. In the locked position, the lock is in contact with both the electrical lead and the housing thereby grounding the selected wire connected to the lead. When unlocked by the key, the lock moves away from the end of the lead within the housing thereby open circuiting the path between the grounded plate and the selected wire.

4 Claims, 5 Drawing Figures

SAFETY LOCKING SYSTEM

BACKGROUND OF THE INVENTION

1. Field of the Invention

The invention pertains to the field of locking mechanisms for disabling motor vehicles to prevent unauthorized use.

2. The Prior Art

There has been a continuing problem with respect to vehicles such as golf carts, snow mobiles or motor cycles to provide an efficient and inexpensive lock mechanism which will thwart unauthorized use of such vehicles.

SUMMARY OF THE INVENTION

An electrical safety switch that may be used to ground a selected electrical wire, such as an ignition wire on a vehicle, has a movable locking member which in a locked position can ground the wire and in an unlocked position provides an open circuit between the wire and ground.

The switch has a tapered conducting housing which is mounted through a hole in a grounded plate, or brought into contact with a ground wire, and held in place by a threaded nut or other retaining means.

The housing has an axial boring in which is mounted a key operated tumbler plug lock or other equivalent lock. The lock is movable axially within the housing boring from a depressed, locked position to an extended, unlocked position in response to a selected key being inserted into a key slot in the lock.

An insulator with an elongated body portion and a shoulder at one end is mounted with the shoulder at the bottom of the axial boring of the body and the elongated, threaded body portion of the insulator extending through a hole at the rear of the body.

The insulator has an axial hole in which is located at lead with a spring contact. The spring contact is mounted within the axial body boring but supported by the shoulder of the insulator. The selected wire is attached to the external end of the lead.

The elongated body portion of the insulator can be inserted through a hole in the mounting plate and a nut screwed onto the insulator threads to rigidly clamp the housing to the plate.

When the lock is depressed in the housing, it compresses the spring contact and provides a path to ground via the metallic housing to the grounded plate.

When unlocked, the lock moves to its extended position resulting in an open circuit between the spring contact and the lock.

The lock may be depressed, and locked, without the use of a key. The body need not be metallic so long as a connection to ground or any other desired potential is provided between the lock and the attached wire when the lock is depressed.

In an alternate embodiment of the invention, the lock may be removed from the housing when unlocked.

DETAILED DESCRIPTION OF THE PREFERRED EMBODIMENTS

Figures 1, 2, 3, 4, 5:
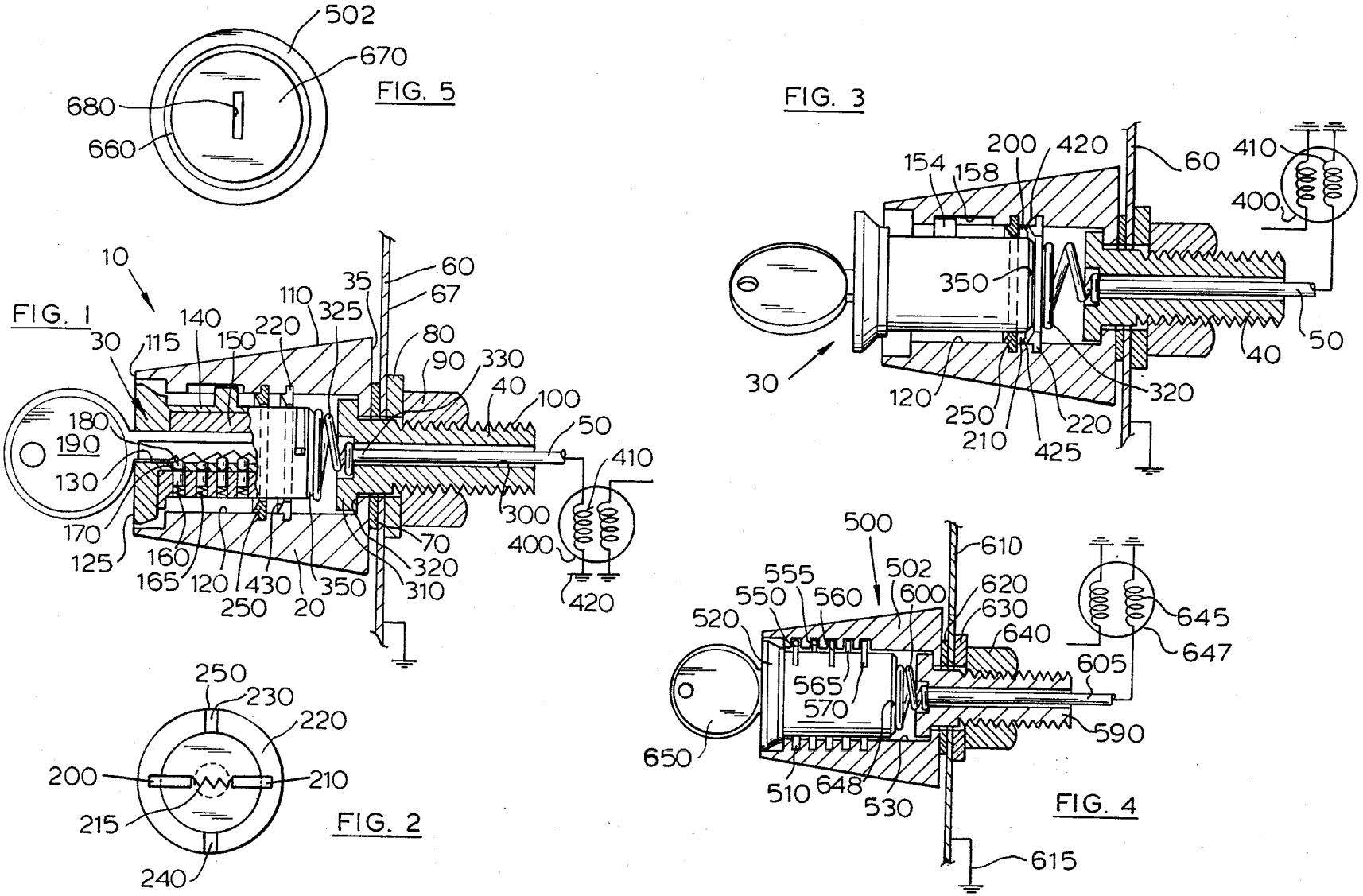
FIG. 1 is a side view, partly in section with parts broken away to show the lock mechanism.
FIG. 2. is an end view of the cylinder plug.
FIG. 3 is a side view partly in section with the cylinder plug in the unlocked position.
FIG. 4 is a side view, partly in section of a second embodiment of the invention.
FIG. 5 is a front elevation of the second embodiment.

Not by way of limitation but by way of disclosing the best mode of practicing my invention and by way of enabling one of ordinary skill in the art to practice my invention there is shown generally in FIGS. 1 through 4 two exemplary embodiments of my invention.

With reference to FIG. 1, a safety lock mechanism 10 has a housing 20 with a slidably movable lock member 30 mounted therein. The housing 20 has, extending from a rear surface 35 thereof, an elongated insulator member 40 through which passes a selected connection wire 50. The safety locking switch 10 is mounted on a plate 60 which is grounded to the electrical system of the vehicle to be disabled. For mounting purposes a lock washer 70 is located between the surface 35 of the housing 20 and the plate 60. A flat washer 80 and a threaded nut 90 are mounted over an external threaded surface 100 of the elongated insulating member 40 and adjacent an interior surface 67 of the grounded plate 60.

The housing 20 has a tapered external surface 110 with a substantially planar front surface 115. The lock mechanism 30 is located within a boring 120 within the housing 20. The lock mechanism 30 may be any conventional cylinder lock type apparatus as made by companies such as All Lock. In an exemplary embodiment, the lock member 30 of FIG. 1 has a front planar surface 125 wherein is located a key slot 130. The lock member 30 also has an elongated exterior housing member 140 and an interior, rotary, cylinder member 150. An alignment key 154 engages a slot 158 in the housing 20. The housing member 140 contains a plurality of spring biased locking pins such as a locking pin 160 and associated biasing spring 165. Within the rotary cylinder 150 are a plurality of cylinder borings such as the cylinder boring 170 containing cylinder pin 180. When a key such as a key 190 is inserted into the key slot 130 the plurality of cylinder pins 180 are displaced laterally with respect to the cylinder 150 thereby driving the locking pins 160 into the housing 140 and permitting the cylinder 150 to rotate a selected amount.

As indicated with respect to FIG. 2, when the cylinder 150 rotates a selected amount, locking members 200 and 210 biased outward by a spring 215 are rotated essentially 90° from a locked position with respect to annular plate 220 to an unlocked position and are permitted to slide through slots 230,240 in the plate 220 thereby permitting the lock member 30 to move axially with respect to the housing 20. A second annular plate 250 displaced with respect to the first annular plate 220 limits the axial movement of the cylinder 30. When the lock member 30 has been moved axially so that the spring biased members 200,210 are adjacent the annular ring 250, the lock member 30 is blocked from further axial motion. Cylinder 150 may then be rotated 90° in the reverse direction which in turn rotates the members 200 and 210 90° in the reverse direction. The key 190 then can be removed from the key slot 130.

The elongated insulator member 40 has a through bore 300 through which the electrical conductor 50 extends and has a shoulder 310 which is located internal to the boring 120 and which abuts an internal surface 320 of the housing 20. A spring contact 325 is electrically and mechanically connected to an end 330 of the electrical wire 50 which extends through the boring 300. The spring contact 325 is supported by and is insulated from the housing 20 by the shoulder 310 of the elongated insulator 40.

When in the locked or safety position, the locking member 30 is depressed into the boring 120 bringing an end surface 350 of the housing 140 into contact with the spring member 320. An electrical circuit is completed between the wire 50, the spring contact 325, the lock member 30, the housing 20 and the grounded plate 60. Thus, the ignition system indicated in FIG. 1. by an ignition coil 400 has a primary coil 410 both sides of which are connected to electrical common 420 of the vehicle when the member 30 is depressed into the lock position.

In FIG. 3 the locking member 30 is shown in its unlocked position with the locking studs 200 and 210 being located between the annular plates 220 and 250. In the unlocked position the surface 350 of the locking member 30 does not engage the spring contact 320 thereby providing an open circuit between the electrical wire 50 and the ground plate 60. The ignition coil 400 is then enabled to generate ignition signals.

If desired the locking member 30 can be relocked merely by sliding it axially inwardly along the bore 120, toward the insulator 40. The two locking members 200 and 210 each have a biased surface, the surfaces 420 and 425 respectively which can interact with the biased surface 430 of the locking ring 220 thereby causing the members 220,210 to retract and slide past the locking ring 220 which in turn relocks the locking member 30 and also regrounds the electrical wire 50.

FIG. 4 shows a second embodiment 500 having a housing 502 which is substantially the same as the housing 20 except for the fact that the housing 502 has therein a series of five annular grooves such as the groove 510. FIG. 4 also shows a five tumbler plug assembly 520 located in a boring 530 of the housing 502.

External extensions 550,555,560,565, and 570 of the tumblers of the plug assembly 520 are shown in FIG. 4 engaging the plurality of annular interior slots such as the slot 510. The lock assembly 500 also includes an elongated insulator 590 which is identical to the insulator 40, a spring contact 600 connected to an electrical wire 605 each of which are identical to the contact 325 and the electrical wire 50 of FIG. 1. The housing 502 of FIG. 4 is mounted on a plate 610, which could be grounded to the vehicle's electrical system as was the plate 60, by means of a lock washer 620, a flat washer 630 and a nut 640 all corresponding to the lock washer 70, the flat washer 80 and the nut 90 of FIG. 1. When the cylinder plug 520 is locked to the housing 502 a completed circuit exists between the wire 605, connected to a primary 645 of an ignition coil 647, the spring contact 600, a rear surface 648 of the cylinder 520, the housing 502 and the grounded plate 610.

A key 650 may be inserted into a key slot of the cylinder 520 and turned thereby retracting the external locking members 550 through 570 and permitting the plug assembly 520 to be removed from the boring 530 of the housing 505. Once the assembly 520 has been unlocked and removed there is no longer a close circuit between the ignition coil 647 and the grounded plate 610. As a result the vehicle may then be operated.

FIG. 5 is a planar front view of the lock 500 showing the housing 502, a front planar end 660 of the cylinder plug 520 and a rotary cylinder 670 with a key slot 680 wherein is inserted the key 650.

While my exemplary embodiments have been shown connected to an ignition coil, it will be understood that the principal of my invention, using the lock member as an element in the path to directly provide a selected potential to a wire instead of having an additional electrical switch associated with the lock, is applicable to vehicles that do not have an ignition coil but perhaps might be all electric vehicles. In such an instance, instead of grounding out the primary of the ignition coil another selected electrical point in the vehicle would be grounded, or have some other selected potential applied thereto.

Although various modifications might be suggested by those skilled in the art, it should be understood that I wish to embody within the scope of the patent warranted hereon all such modifications as reasonably and properly come within the scope of my contribution to the art.

I claim as my invention:

1. A key operated safety lock mountable on a plate with a hole therein for providing a closed circuit between a selected wire and the plate comprising:

an elongated tapered conductive housing mountable on the plate with a centered axial boring therein and a restriction in said boring adjacent a rear surface of said housing;

a cylindrical, conducting, means for locking, having a key slot, mounted within said boring and movable axially a limited distance from a locked position to an unlocked position in response to a selected key inserted into said key slot;

an elongated rigid insulator with a shoulder at a first end thereof, a threaded body portion and an axial boring therethrough positioned with said shoulder in said tapered housing adjacent said restriction, with a portion of said insulator extending through said restriction and the remainder of said insulator extending axially away from said rear surface of said housing, a nut threadable onto said insulator, an electrical conductor formed as a substantially straight elongated conducting wire having an end shaped as a compression spring, said compression spring is positioned in said axial boring adjacent said shoulder of said insulator and said wire extends through said axial boring in said threaded body of said insulator, whereby said tapered housing is securely connectable to the plate by extending said threaded body portion of said insulator through the hole in the plate and threading said nut onto said threaded body portion of said insulator behind the plate and only when said conducting means for locking is in the locked position does an end of said means for locking contact an end of said compression spring to provide a closed circuit between said wire and the plate.

2. In a key operated safety lock mountable on a plate with a hole therein for providing a closed circuit between a selected wire and the plate wherein the lock has an elongated conductive housing mountable on the plate with a centered axial boring therein and a key actuated cylindrical means for locking mounted within said boring movable axially a limited distance from a locked position to an unlocked position in response to a selected key being inserted into said key slot, an improvement comprising:

an exterior tapered surface on said housing and a restriction in said boring adjacent a rear surface of said housing, an elongated rigid insulator with a shoulder at a first end thereof and an axial boring therethrough positioned with said shoulder in said boring in said tapered housing adjacent said restriction, with a portion of said insulator extending through said restriction, and with a section of said insulator extending axially away from said rear surface of said housing, a fastening means connectable to said section of said insulator, an electrical conductor formed as a substantially straight elongated conducting body having an end shaped as a compression spring, said compression spring is positioned in said axial biring in said tapered housing adjacent said shoulder of said insulator with said elongated conducting body extending through said axial boring in said insulator, whereby said tapered housing is securely connectable to the plate by passing said section of said insulator through the hole in the plate and attaching said fastening means onto said section of said insulator behind the plate, when the means for locking is in the locked position, an end of the means for locking contacts an end of said compression spring providing a closed circuit between said elongated conducting body and the plate, and when the means for locking is moved axially away from the locked position to the unlocked position, said end of said means for locking moves away from said end of said compression spring thereby opening the circuit between said elongated conducting body and the plate.

3. The key operated safety lock according to claim 2, wherein:

said body portion of said elongated rigid insulator is threaded and said means for fastening comprises a nut threadable onto said insulator.

4. The key operated safety switch according to claim 2, wherein said means for locking is axially movable from an unlocked to a locked position without using a key.

* * * * *